US012642396B2

(12) United States Patent
Kuhns et al.

(10) Patent No.: US 12,642,396 B2
(45) Date of Patent: Jun. 2, 2026

(54) MODULAR SHELF SYSTEM

(71) Applicant: Project Soak, LLC, Irving, TX (US)

(72) Inventors: Matthew A. Kuhns, Canfield, OH (US); Ronald D. Barndt, Bethlehem, PA (US); Eryk Luczynski, Sayreville, NJ (US); Harshil Sheth, Somerset, NJ (US)

(73) Assignee: Project Soak, LLC, Irving, TX (US)

( * ) Notice: Subject to any disclaimer, the term of this patent is extended or adjusted under 35 U.S.C. 154(b) by 247 days.

(21) Appl. No.: 18/206,174

(22) Filed: Jun. 6, 2023

(65) Prior Publication Data

US 2023/0397776 A1 Dec. 14, 2023

Related U.S. Application Data

(60) Provisional application No. 63/350,948, filed on Jun. 10, 2022.

(51) Int. Cl.
*A47K 3/32* (2006.01)
*A47K 3/28* (2006.01)

(52) U.S. Cl.
CPC ..... *A47K 3/325* (2013.01); *A47K 3/281* (2013.01)

(58) Field of Classification Search
CPC .. A47K 3/281; A47B 47/0075; A47B 81/002; A47B 57/10; F25D 25/024; F25D 25/025
See application file for complete search history.

(56) References Cited

U.S. PATENT DOCUMENTS

| | | | | |
|---|---|---|---|---|
| 4,319,792 | A * | 3/1982 | Britt | A47B 57/10 211/208 |
| 5,241,715 | A * | 9/1993 | Duvall | A47K 3/281 4/596 |
| 5,642,924 | A * | 7/1997 | Wohlrab | A47B 57/16 211/134 |
| 8,819,876 | B2 * | 9/2014 | Dabrowski | A47K 3/281 211/119.011 |
| 9,259,088 | B1 * | 2/2016 | Mobley | A47B 96/024 |
| 9,462,885 | B2 * | 10/2016 | Cohen | A47K 3/282 |
| 10,004,363 | B2 | 6/2018 | Cohen et al. | |
| 10,455,988 | B2 * | 10/2019 | Lyons | A47K 3/001 |
| 2014/0231298 | A1 * | 8/2014 | DiCianni | A47K 3/281 206/509 |

* cited by examiner

*Primary Examiner* — Erin Deery
(74) *Attorney, Agent, or Firm* — Bradley Arant Boult Cummings LLP; Phillip E. Walker; Alex H. Huffstutter

(57) ABSTRACT

A modular shelf system for a bath or shower wall, comprising one or more shelves and a panel, wherein the panel comprises a flange configured to be parallel planar with a bath or shower wall, the panel comprises a cavity configured to removably receive the one or more shelves, the panel cavity is configured to be recessed within the bath or shower wall, the one or more shelves are configured to be removably coupled to the panel cavity, and when the one or more shelves are removably coupled to the panel cavity, they are configured to resist being inadvertently pulled out of the cavity and inadvertently tilted.

11 Claims, 7 Drawing Sheets

MODULAR SHELF SYSTEM

The disclosure is directed toward a modular shelf assembly, in particular to a modular shelf assembly configured to be installed within a wall, more particularly to a modular shelf assembly to be installed within a bath or shower wall.

BACKGROUND

Bath and shower enclosures may typically be cluttered with toys, shampoo bottles, soap, washcloths, and the like. Desired is a shelf system, in particular a shelf system for a bath or shower enclosure that is adjustable and provides for more useable space.

SUMMARY

Accordingly, disclosed is a modular shelf system for a bath or shower wall, comprising one or more shelves and a panel, wherein the panel comprises a flange configured to be parallel planar with a bath or shower wall, the panel comprises a cavity configured to removably receive the one or more shelves, the panel cavity is configured to be recessed within the bath or shower wall, the one or more shelves are configured to be removably coupled to the panel cavity, and when the one or more shelves are removably coupled to the panel cavity, they are configured to resist being inadvertently pulled out of the cavity and inadvertently tilted.

Also disclosed is a shelf for a modular shelf system, wherein the shelf is configured to be removably coupled to a wall alcove, the shelf comprises a back pair of mating features configured to prevent the shelf from being inadvertently tilted, and the shelf comprises a front pair of mating features configured to prevent the shelf from being inadvertently pulled away from the wall alcove.

Also subject of the disclosure is a panel for a modular shelf system, wherein the panel comprises a flange configured to be parallel planar with a wall, the panel comprises a cavity configured to removably receive one or more shelves, and the panel cavity is configured to be recessed within the wall.

In some embodiments, a panel cavity may conveniently be configured to fit between existing studs of a wall, thereby providing extra space for an enclosure to place and store items.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1A:
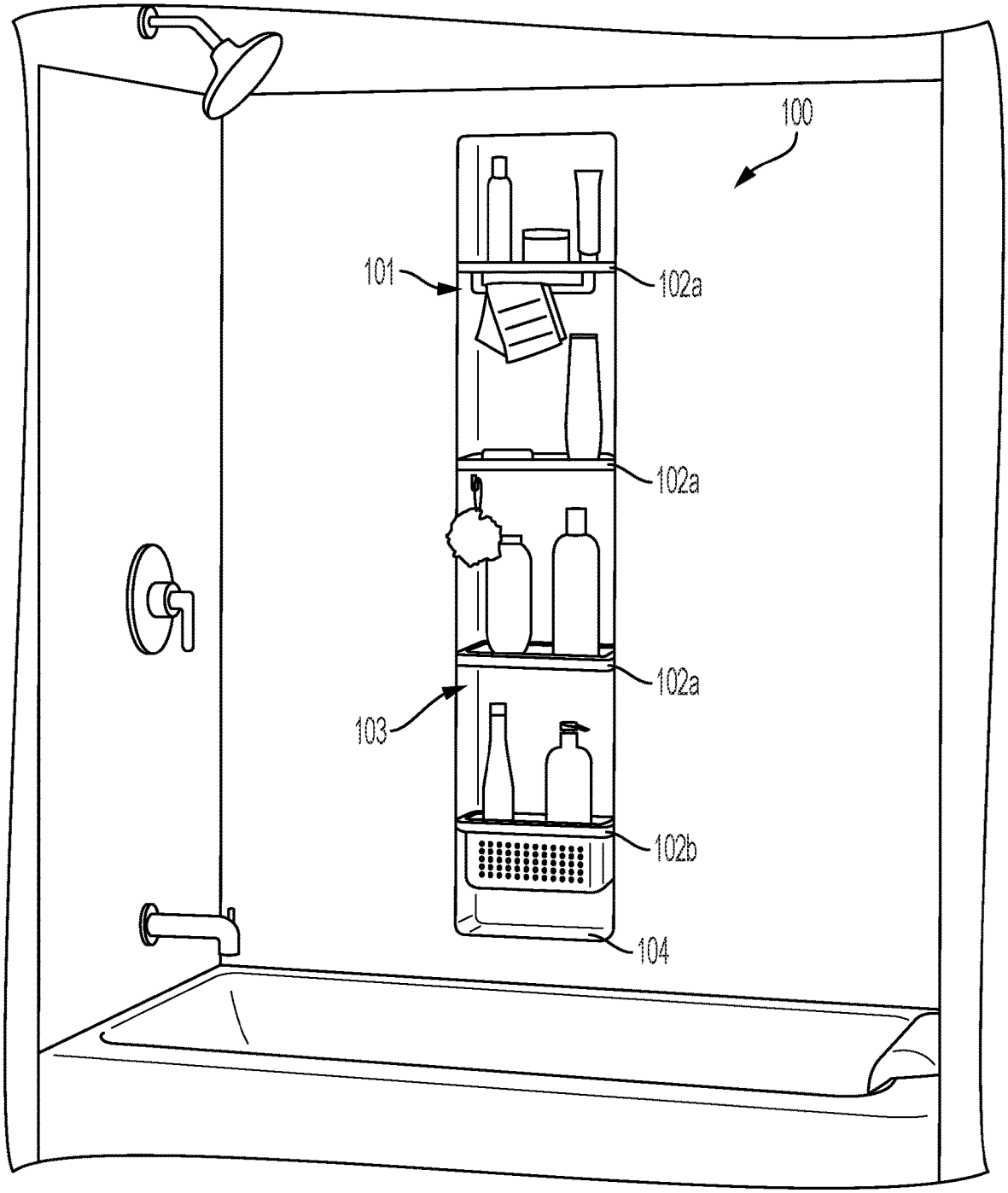
FIG. 1A shows a modular shelf system positioned in a bath wall, according to an embodiment.

FIG. 1A provides a view of modular shelf system 100 positioned in a bath wall, according to an embodiment. Modular system 100 comprises panel 101 and shelves 102*a* and 102*b*. In an embodiment, panel 101 is configured to fit in a space between wall studs, thereby providing increased storage space in a bath area. Shelves 102*a* and 102*b* are removably coupled to panel cavity 103, and may be moved vertically within cavity 103. Shelves 102*a* are typical shelves, while shelf 102*b* comprises a basket. Panel bottom surface 104 may be positioned at a convenient height and configured for a person to rest a foot on for bathing or shaving.

Figure 1B:
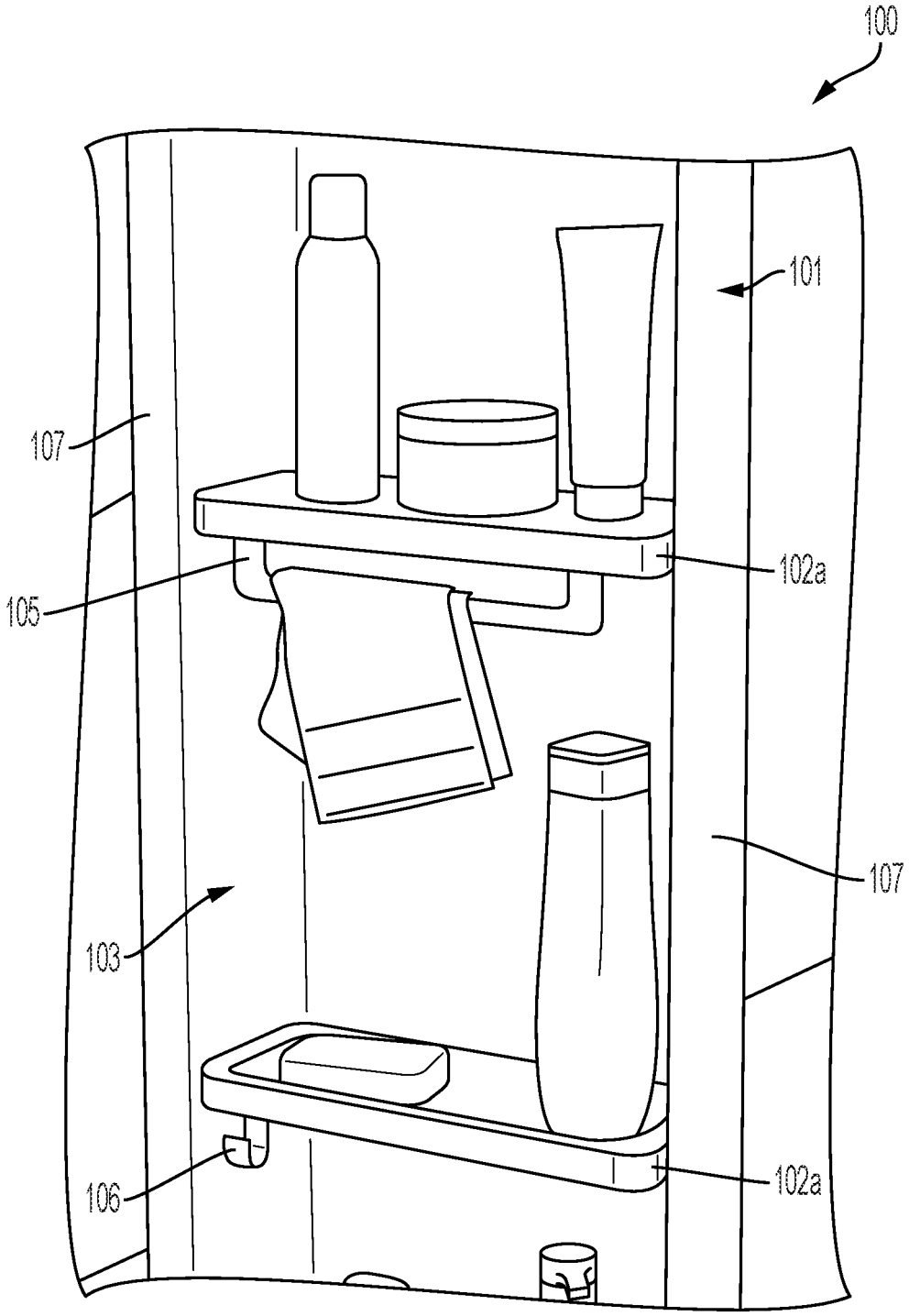
FIG. 1B and FIG. 1C show portions of a modular shelf system, according to some embodiments.
Figure 1C:
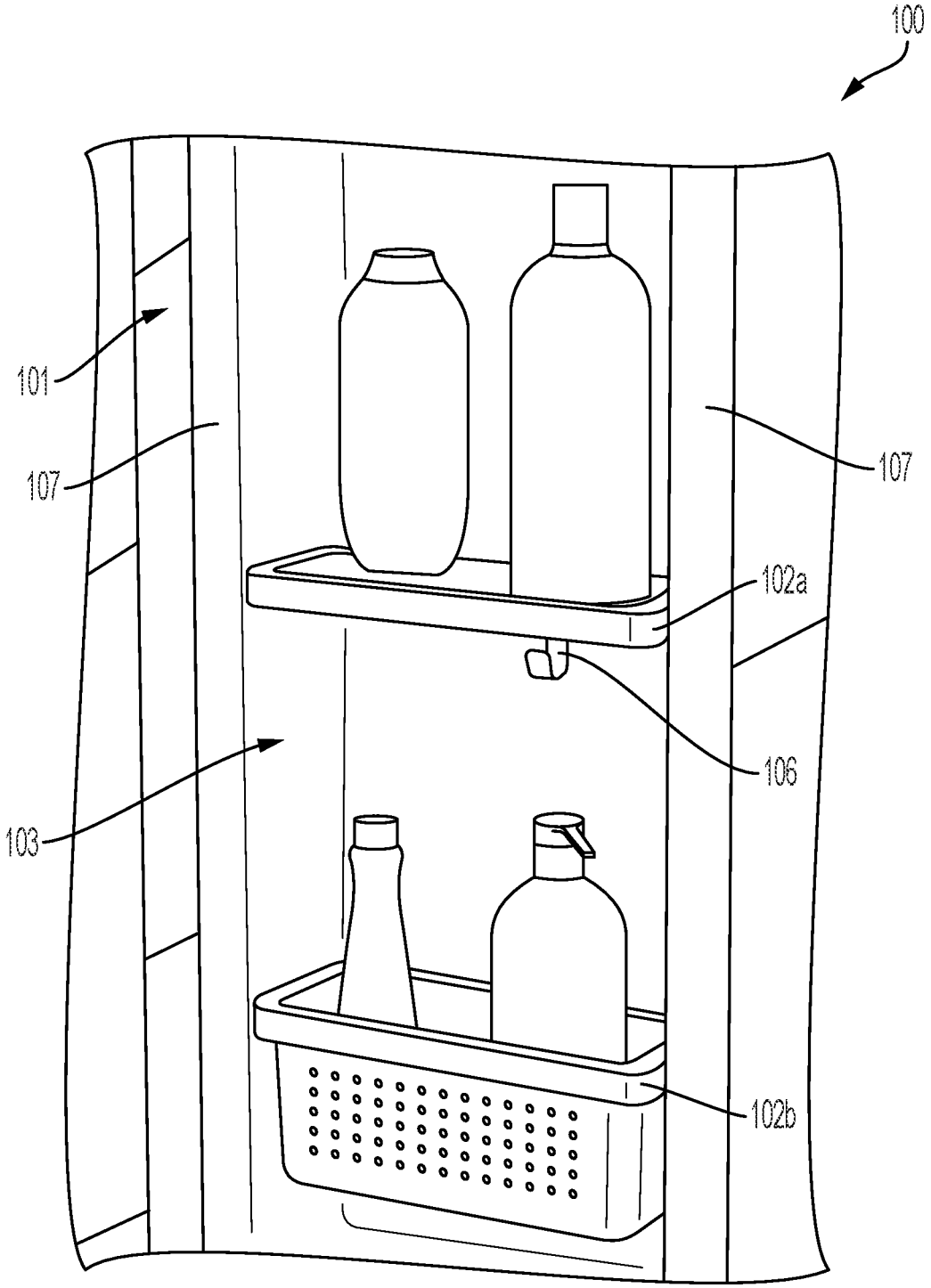

FIG. 1B and FIG. 1C provide close-up views of shelves 102*a* and 102*b*, according to some embodiments. Shelves 102*a* may comprise towel bar 105 and/or hook 106. Shelf 102*b*, comprising a basket, may conveniently be used to store bath toys, etc. In an embodiment, shelves 102*a* may comprise a dish-shape so that soap or other items so not slip out. In other embodiments, shelves may comprise an unnoticeably slant configured so that water will run off and not pool on a shelf. A slant may be from front-to-back or may be from back-to-front. Also visible in FIG. 1B and FIG. 1C is flange 107, positioned about at entire perimeter of panel 101. Modular assembly 100 is positioned parallel planar to a bath wall, for instance, flange 107 is parallel planar to a bath wall.

Figure 2:
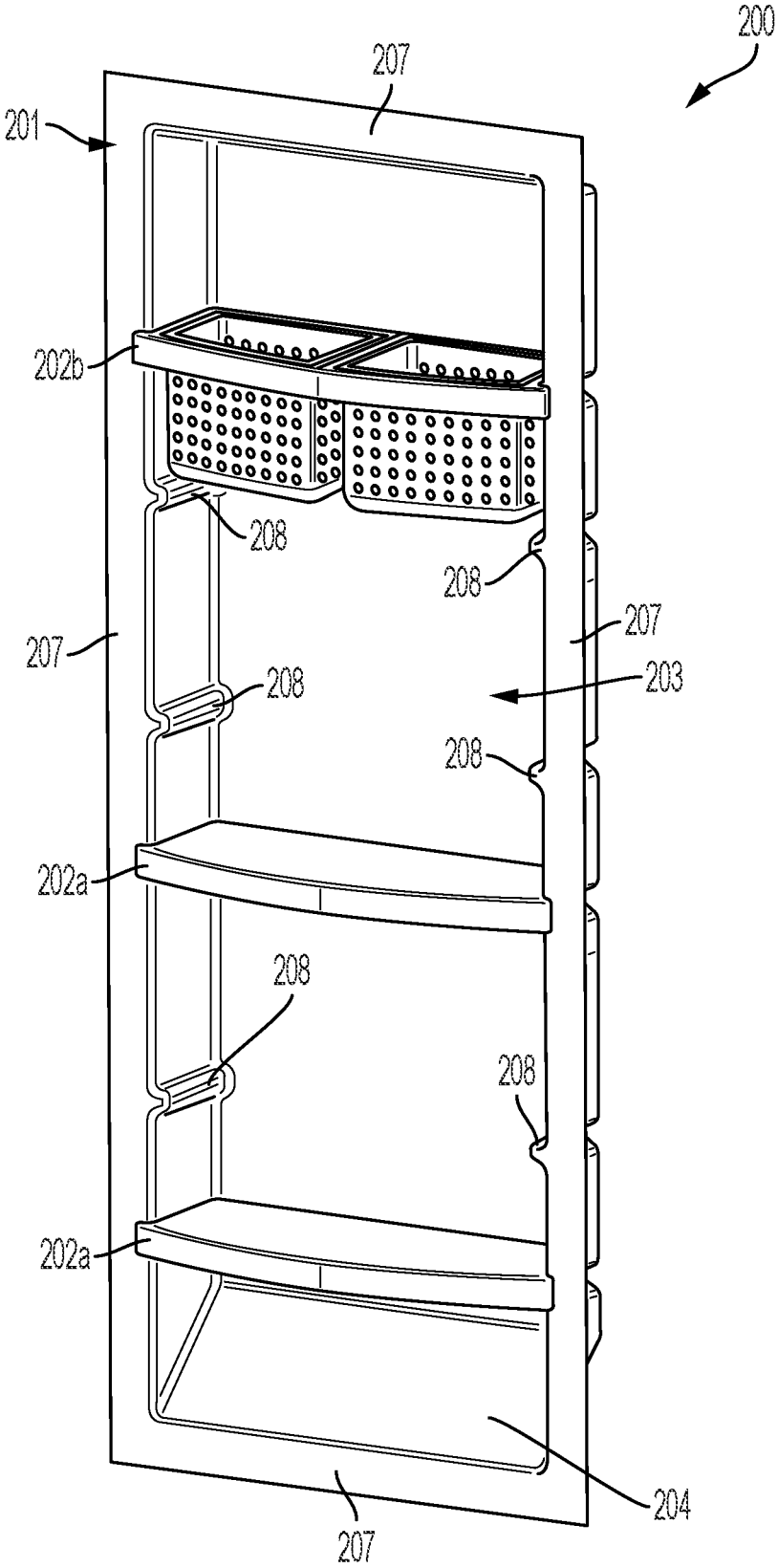
FIG. 2 provides a view of a modular shelf system, according to an embodiment.

FIG. 2 shows modular shelf assembly system 200, according to an embodiment. Flange 207 is positioned about an entire perimeter of panel 201. Shelves 202*a* and 202*b* are configured to removably couple to panel cavity 203 via sets of mating features 208. Panel bottom surface 204 is angled so that one may rest a foot thereon for bathing or shaving.

Figure 3A:
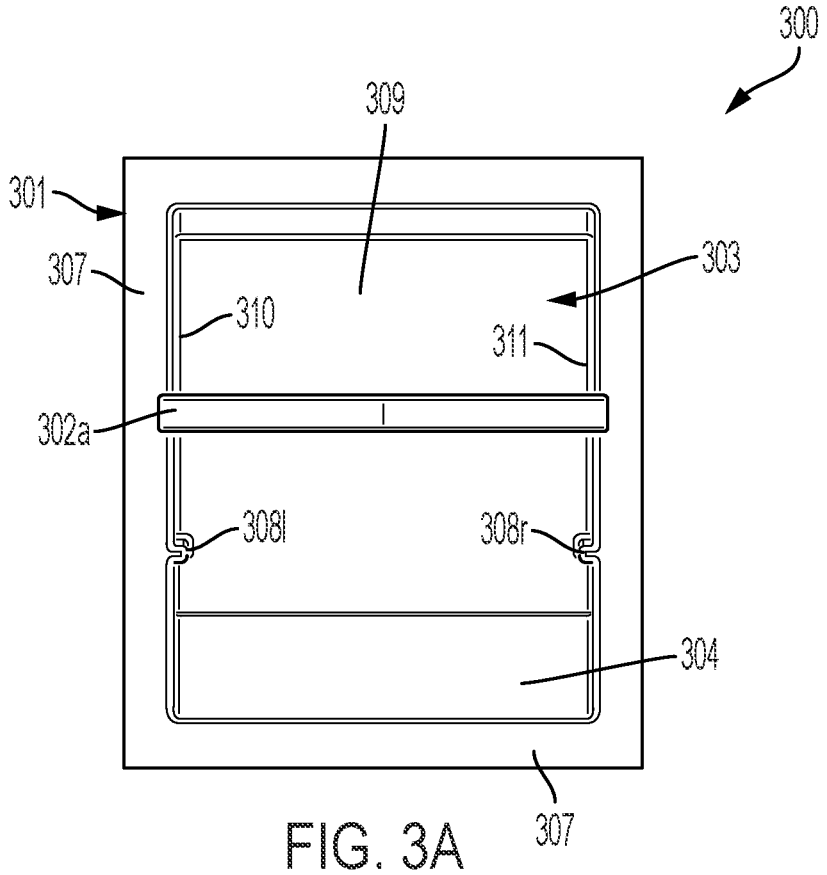
FIG. 3A, FIG. 3B, FIG. 3C, FIG. 3D, and FIG. 3E provide views of a modular shelf assembly and a shelf coupling feature, according to some embodiments.
Figure 3B:
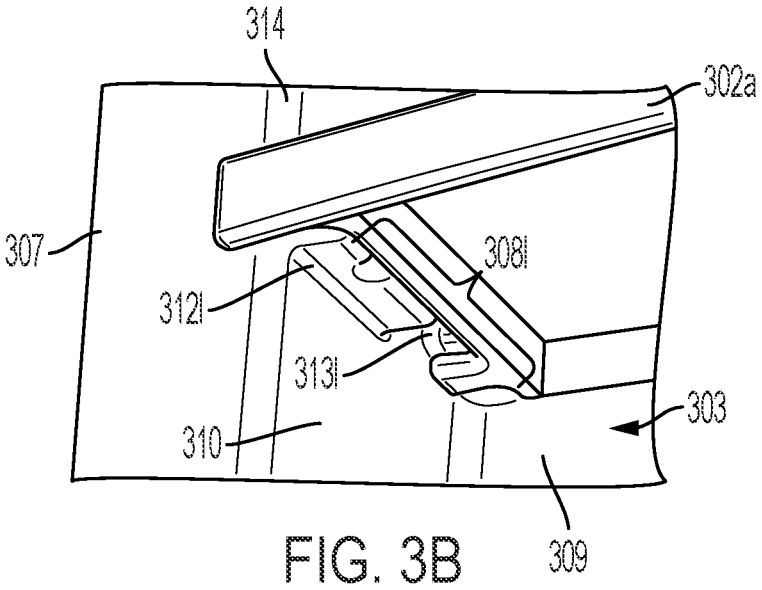

FIG. 3A, FIG. 3B, FIG. 3C, FIG. 3D, and FIG. 3E provide views of modular shelf assembly 300, according to some embodiments. FIG. 3A shows a set of mating features 308*l*/308*r*. Shelf 302*a* is removably coupled to a set of mating features 308*l*/308*r* (not visible in FIG. 3A). Also shown are flange 307, cavity 303, panel bottom surface 304, cavity inner surface 309, cavity left surface 310, and cavity right surface 311. FIG. 3B provides a left, underside perspective view of shelf 302*a* removably coupled to panel cavity 303, according to an embodiment. Mating feature set 308*l*/308*r* comprises a pair of rear mating features 313*l*/313*r*, and a pair of forward mating features 312*l*/312*r*. Only the left side of the pairs of mating features are shown. Mating feature 313*l* is positioned on cavity left side surface 310, towards a location where left side surface 310 meets inner surface 309. Mating feature 312*l* is positioned on cavity left side surface 310 towards front edge 314. Panel 301 comprises right side mating features (313*r* and 312*r*, not visible), corresponding to each rear, left side mating feature 313*l* and each forward, left side mating feature 312*l*.

Figure 3C:
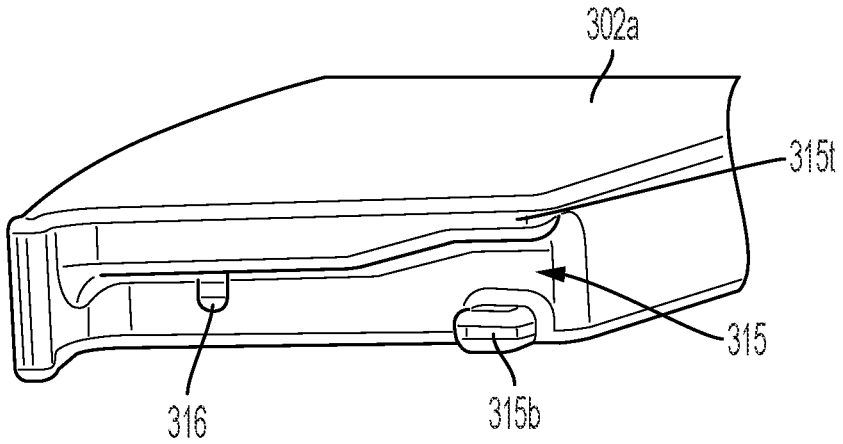
Figure 3D:
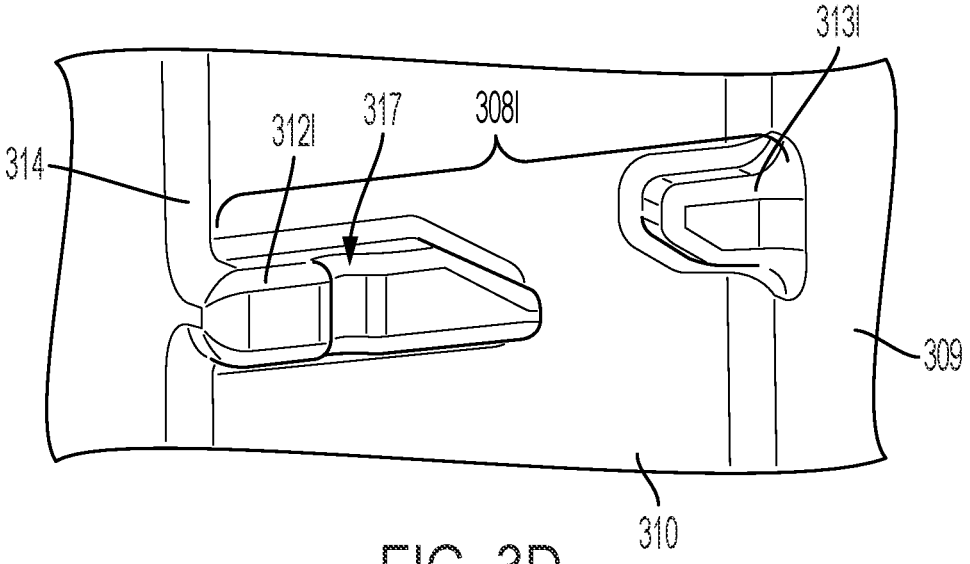

FIG. 3C and FIG. 3D provide views of shelf 302*a* mating features (from a right side), and views of cavity left side 310 mating features 312*l* and 313*l*, according to some embodiments. Shelf 302*a* comprises female mating feature 315 configured to removably couple to cavity rear male mating feature 313*l*. Shelf 302*a* comprises male mating feature 316 configured to removably couple to cavity forward female mating feature 317. Shelf 302*a* comprises corresponding mating features on its left side, which are the mating features that would couple to cavity 303 left side mating features. Shelf female mating feature comprises top portion 315*t* and bottom portion 315*b*.

Figure 3E:
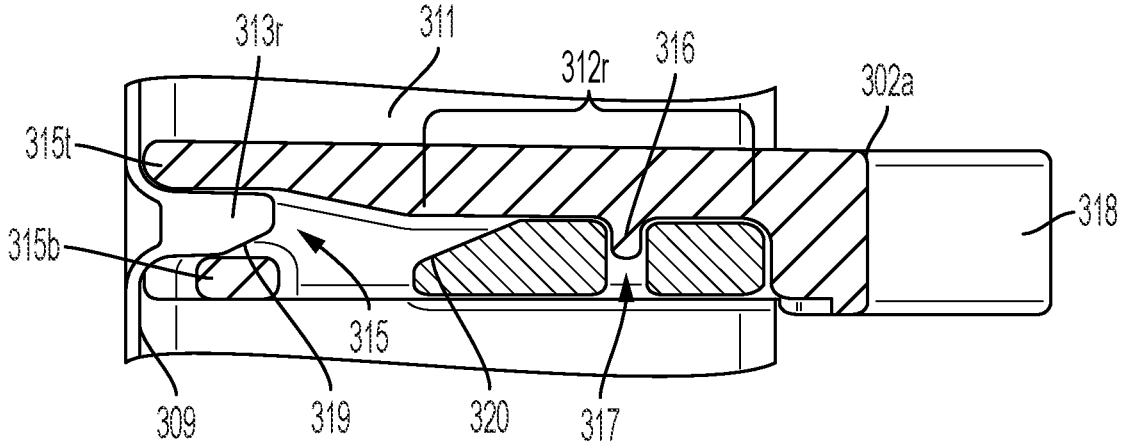

FIG. 3E shows a cross-section of shelf 302*a* removably coupled to right side 311 of cavity 303. Shelf male feature 316 is coupled to panel cavity female mating feature 317. Shelf female mating feature 315 is coupled to panel cavity male mating feature 313*r*. Removably coupled shelf 302*a* will resist being inadvertently tilted relative to cavity 303, as shelf female mating feature 315 top and bottom portions 315*t* and 315*b* are configured to resist any up and down movement as they are positioned above and below feature 313*r*. Removably coupled shelf 302*a* will resist being inadvertently pulled out of cavity 303, as shelf male feature 316 is positioned against a portion of mating feature 312*r*. Inadvertent "tilting" or "pulling-out" of a shelf might occur if a bather grabs on to a shelf for support, for example. Shelf 302*a* comprises shelf face 318, configured to hide mating features from view. Panel cavity mating features 312*r* and 313*r* comprise complimentary angled surfaces 320 and 319, configured to guide feature 315*b* as cavity 303 receives or releases shelf 302*a*.

As shown in the figures, panel may comprise a pair of rear male mating features and a pair of forward female mating features, configured to couple to female and male mating features of a shelf, respectively. In some embodiments, coupling means may be reversed, for example, a panel may comprise a pair of rear female mating features configured to couple to male mating features of a shelf. In some embodiments, a panel may comprise a pair of forward male mating features, configured to couple to female mating features of a shelf.

In some embodiments, a modular shelf system may be configured to be positioned in a bath or shower wall side as show for example in FIG. 1A. In other embodiments, a modular shelf system may be configured to be positioned in a corner of a bath or shower wall. In this instance, the shelves and a panel may comprise about a 90 degree angle, matching a wall corner. In some embodiments, a modular shelf system may be configured to fit in a space between wall studs. A present modular shelf system provides storage options to create a clutter-free bath or shower enclosure. Shelves may be positioned within a panel in a variety of configurations; the shelves themselves may be customized, for example they may be a typical shelf or may comprise a basket or other feature, and the shelves may be arranged and spaced vertically in a panel as desired. Dangerous items may be placed out of reach of children, and certain items may be placed for ease of access.

Shelves are removably coupled to a panel cavity, meaning they may be rearranged in the cavity as desired, as long as there are a set mating features positioned in the panel where desired. Sets of mating features may be positioned vertically within a panel cavity at regularly-spaced intervals. In other embodiments, sets of mating features may be positioned vertically within a panel cavity at irregularly-spaced intervals.

In some embodiments, a panel may comprise a bottom surface, which may be conveniently situated for one to rest a foot on for bathing or for shaving. A panel bottom surface may be essentially "flat" or may be angled. In such a position, a person may grab a shelf for support. Accordingly, preferred is a shelf which may resist being tilted and/or being pulled-out from a panel cavity when a person places weight on or pulls on the shelf. If a shelf is configured to resist being tilted, this means if a pressure is applied to a top, front of a shelf, lifting of the rear of the shelf is prevented. The term "tilted" may also be referred to as "flipped-out"—that is to say, a present shelf is configured to resist being flipped-out when a top, front of a shelf is leaned on.

In some embodiment, for one to remove a shelf from a cavity, one would lift a shelf up from the front and pull out. To inset and removably couple a shelf to a panel cavity, one would insert at a downward angle, and let down the shelf front. In some embodiments, a panel rear mating feature and a panel forward mating feature may comprise corresponding angled surfaces to facilitate this.

In some embodiments, a panel may comprise a thermoformed thermoplastic. Thermoplastics include for example polyolefins, polyesters, polyamides, polystyrenes, poly (meth)acrylates, copolymers thereof, and blends thereof. In some embodiments, a shelf may comprise an injection molded thermoplastic.

In some embodiments, an opening may be formed in a bath or shower wall in order to install a present panel. In particular, an opening may be formed between studs within a wall. A panel may be affixed to a bath or shower wall with a suitable caulk or adhesive.

In some embodiments, a shelf may comprise a largest dimension of from any of about 4 inches, about 5 inches, about 6 inches, about 7 inches, about 8 inches, or about 9 inches, to any of about 10 inches, about 11 inches, about 12 inches, about 13 inches, about 14 inches, about 15 inches, about 16 inches, about 17 inches, about 18 inches, about 19 inches, about 20 inches, about 21 inches, about 22 inches, about 23 inches, about 24 inches, or more.

In some embodiments, a panel may comprise a depth, for example a distance from a front edge to an inner surface, of from about any of 2 inches, about 3 inches, or about 4 inches, to any of about 6 inches, about 7 inches, about 8 inches, or more.

In some embodiments, a panel may comprise a height of from any of about 12 inches, about 16 inches, about 20 inches, about 24 inches, about 28 inches, about 32 inches, about 36 inches, or about 40 inches, to any of about 44 inches, about 48 inches, about 52 inches, about 56 inches, about 60 inches, about 64 inches, about 68 inches, about 72 inches, about 76 inches, about 80 inches, about 84 inches, about 88 inches, about 92 inches, or more.

In some embodiments, a panel may comprise a width of from any of about 6 inches, about 8 inches, about 10 inches, about 12 inches, or about 14 inches, to any of about 16 inches, about 18 inches, about 20 inches, about 22 inches, about 24 inches, about 26 inches, about 28 inches, or more. This would be for a "flat" panel configured to be positioned in a bath or shower wall side. For an "angled" panel configured to be positioned in a bath or shower wall corner, these measurements may correspond to a sum of a left side width plus a right side width.

Following are some embodiments of the disclosure.

In a first embodiment, disclosed is a modular shelf system for a bath or shower wall, comprising one or more shelves and a panel, wherein the panel comprises a flange configured to be parallel planar with a bath or shower wall, the panel comprises a cavity configured to removably receive the one or more shelves, the panel cavity is configured to be recessed within the bath or shower wall, and the one or more shelves are configured to be removably coupled to the panel cavity. In a second embodiment, disclosed is a modular shelf system according to the first embodiment, wherein when the one or more shelves are removably coupled to the panel cavity, they are configured to resist being inadvertently pulled out of the cavity and inadvertently tilted.

In a third embodiment, disclosed is a modular shelf system according to the first or second embodiments, wherein the panel cavity comprises a plurality of sets of mating features positioned therein, and each set of the plurality of sets of mating features is configured to removably couple to a shelf of the one or more shelves. In a fourth embodiment, disclosed is a modular shelf system according to the third embodiment, wherein the panel cavity comprises a left side surface, a right side surface, and an inner surface, each set of the plurality of sets of mating features comprises a pair of rear mating features and a pair of forward mating features, one of a pair of rear mating features is positioned on the left side surface at or towards a location where the left side surface meets the inner surface, and the other of the pair of rear mating features is positioned at a corresponding position on the right side surface, and one of a pair of forward mating features is positioned on the left side surface at or towards a left side surface front edge, and the other of the pair of forward mating features is positioned at a corresponding position on the right side surface.

In a fifth embodiment, disclosed is a modular shelf system according to embodiment 4, wherein the shelf comprises a pair of female mating features, and wherein the panel cavity rear mating features each comprise a male mating feature configured to removably couple to the shelf female mating features.

In a sixth embodiment, disclosed is a modular shelf system according to embodiments 4 or 5, wherein the shelf comprises a pair of male mating features, and wherein the panel cavity forward mating features each comprise a female mating feature configured to removably couple to the shelf male mating features. In a seventh embodiment, disclosed is a modular shelf system according to any of embodiments 4 to 6, wherein coupling of the shelf to the pair of rear mating features is configured to prevent the shelf from being inadvertently tilted. In an eighth embodiment, disclosed is a modular shelf system according to any of embodiments 4 to 7, wherein coupling of the shelf to the pair of forward mating features is configured to prevent the shelf from being inadvertently pulled out of the cavity.

In a ninth embodiment, disclosed is a modular shelf system according to any of the preceding embodiments, wherein the flange extends around an entire perimeter of the panel. In a tenth embodiment, disclosed is a modular shelf system according to any of the preceding embodiments, wherein a shelf of the one or more shelves comprise a basket. In an eleventh embodiment, disclosed is a modular shelf system according to any of the preceding embodiments, wherein a shelf of the one or more shelves comprise a towel bar or a hook.

In a twelfth embodiment, disclosed is a modular shelf system according to any of the preceding embodiments, wherein a shelf of the plurality of shelves, when removably coupled to the panel, is positioned such that water is configured to run off the shelf. In a thirteenth embodiment, disclosed is a modular shelf system according to any of the preceding embodiments, wherein the panel comprises a bottom surface configured for a person to position a foot on.

In a fourteenth embodiment, disclosed is a modular shelf system according to any of the preceding embodiments, wherein a panel depth, from a front edge to an inner surface, is from about 2 inches to about 8 inches. In a fifteenth embodiment, disclosed is a modular shelf system according to any of the preceding embodiments, wherein a shelf of the one or more shelves comprises a largest dimension of from about 4 inches to 24 inches. In a sixteenth embodiment, disclosed is a modular shelf system according to any of the preceding embodiments, wherein the panel comprises a height of from about 12 inches to about 92 inches and a width of from about 6 inches to about 28 inches.

In a seventeenth embodiment, disclosed is a modular shelf system according to any of the preceding embodiments, wherein the panel comprises a thermoformed thermoplastic. In an eighteenth embodiment, disclosed is a modular shelf system according to any of the preceding embodiments, wherein a shelf of the one or more shelves comprises an injection molded thermoplastic.

In a nineteenth embodiment, disclosed is a shelf for a modular shelf system, wherein the shelf is configured to be removably coupled to a wall alcove, the shelf comprises a back pair of mating features configured to prevent the shelf from being inadvertently tilted, and the shelf comprises a front pair of mating features configured to prevent the shelf from being inadvertently pulled away from the wall alcove. In a twentieth embodiment, disclosed is a shelf according to embodiment 19, wherein the back pair of mating features each comprise a female mating feature. In a twenty-first embodiment, disclosed is a shelf according to embodiments 19 or 20, wherein the front pair of mating features each comprise a male mating feature.

In a twenty-second embodiment, disclosed is a panel for a modular shelf system, wherein the panel comprises a flange configured to be parallel planar with a wall, the panel comprises a cavity configured to removably receive one or more shelves, and the panel cavity is configured to be recessed within the wall. In a twenty-third embodiment, disclosed is a panel according to embodiment 22, wherein the flange extends around an entire perimeter of the panel.

In a twenty-fourth embodiment, disclosed is a panel according to embodiments 22 or 23, wherein the panel cavity comprises a plurality of sets of mating features positioned therein, and each set of the plurality of sets of mating features is configured to removably couple to a shelf of the one or more shelves. In a twenty-fifth embodiment, disclosed is a panel according to any of embodiments 22 to 24, wherein the panel cavity comprises a left side surface, a right side surface, and an inner surface, the panel cavity comprises a plurality of sets of mating features positioned therein, each set of the plurality of sets of mating features is configured to removably couple to a shelf of the one or more shelves, each set of the plurality of sets of mating features comprises a pair of rear mating features and a pair of forward mating features, one of a pair of rear mating features is positioned on the left side surface at or towards a location where the left side surface meets the inner surface, and the other of the pair of rear mating features is positioned at a corresponding position on the right side surface, and one of a pair of forward mating features is positioned on the left side surface at or towards a left side surface front edge, and the other of the pair of forward mating features is positioned at a corresponding position on the right side surface.

In a twenty-sixth embodiment, disclosed is a panel according to embodiment 25, wherein the panel cavity rear mating features each comprise a male mating feature configured to removably couple to a shelf female mating feature. In a twenty-seventh embodiment, disclosed is a panel according to embodiments 25 or 26, wherein the panel cavity forward mating features each comprise a female mating feature configured to removably couple to a shelf male mating feature.

The term "adjacent" may mean "near" or "close-by" or "next to".

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other. The term "positioned on" may mean "coupled to".

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, or about ±5%. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, or about ±5% of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A modular shelf system for a bath or shower wall, comprising one or more shelves and a panel, wherein;

the panel comprises a flange configured to be parallel planar with a bath or shower wall, the panel comprises a panel cavity configured to removably receive the one or more shelves, the panel cavity having side surfaces and an inner surface, the panel cavity including a pair of rear panel mating features extending from the inner surface along each of the side surfaces and a pair of forward panel mating features extending from each of the side surfaces proximate a front edge, the panel cavity is configured to be recessed within the bath or shower wall, the one or more shelves are configured to be removably coupled to the panel cavity via the pair of rear panel mating features and the pair of forward panel mating features, the shelf comprises a pair of female shelf mating features, and the pair of rear panel mating features each include a male mating feature configured to removably couple to the female shelf mating features, the male mating feature of the pair of rear panel mating features having a first geometry, and the shelf comprises a pair of male shelf mating features, and the pair of forward panel mating features each include a female mating feature configured to removably couple to the male shelf mating features, the female mating feature of the pair of forward panel mating features having a second geometry different than the first geometry.

2. The modular shelf system according to claim 1, wherein:

the pair of rear panel mating features and the pair of forward panel mating features define one of a plurality of sets of mating features of the panel cavity, and each set of the plurality of sets of mating features is configured to removably couple to a shelf of the one or more shelves, such that the one or more shelves are configured to resist being inadvertently pulled out of the cavity and inadvertently tilted.

3. The modular shelf system according to claim 1, wherein coupling of the shelf to the pair of rear panel mating features is configured to prevent the shelf from being inadvertently tilted, the coupling including insertion of the male mating features of the pair of rear panel mating features into the pair of female shelf mating features.

4. The modular shelf system according to claim 1, wherein coupling of the shelf to the pair of forward panel mating features is configured to prevent the shelf from being inadvertently pulled out of the cavity, the coupling including insertion of the pair of male shelf mating features into the female mating features of the pair of forward panel mating features.

5. The modular shelf system according to claim 1, wherein the flange extends around an entire perimeter of the panel.

6. The modular shelf system according to claim 1, wherein a shelf of the one or more shelves comprises one or more of a basket, a towel bar or a hook.

7. The modular shelf system according to claim 1, wherein a shelf of the one or more shelves, when removably coupled to the panel, is positioned such that water is configured to run off the shelf.

8. The modular shelf system according to claim 1, wherein the panel comprises a bottom surface configured for a person to position a foot on.

9. The modular shelf system according to claim 1, wherein:

a panel depth, from the front edge to the inner surface, is between 2 inches and 8 inches, a panel height is between 12 inches and 92 inches, and a panel width is between 6 inches and 28 inches.

10. The modular shelf system according to claim 1, wherein a shelf of the one or more shelves comprises a largest dimension between 4 inches and 24 inches.

11. The modular shelf system according to claim 1, wherein the panel comprises a thermoformed thermoplastic, and/or wherein a shelf of the one or more shelves comprises an injection molded thermoplastic, such that the male mating features and female mating features are formed with different molded profiles.

* * * * *